US007980407B2

(12) United States Patent
Shimada

(10) Patent No.: US 7,980,407 B2
(45) Date of Patent: Jul. 19, 2011

(54) SYNTHETIC RESIN CONTAINER

(75) Inventor: Shinji Shimada, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 903 days.

(21) Appl. No.: 10/580,584

(22) PCT Filed: Aug. 19, 2004

(86) PCT No.: PCT/JP2004/011917

§ 371 (c)(1),
(2), (4) Date: Jun. 21, 2006

(87) PCT Pub. No.: WO2005/051786

PCT Pub. Date: Jun. 9, 2005

(65) Prior Publication Data

US 2007/0138122 A1 Jun. 21, 2007

(30) Foreign Application Priority Data

Nov. 26, 2003 (JP) ..... 2003-395890

(51) Int. Cl.
*B65D 1/40* (2006.01)
*B65D 90/00* (2006.01)
*B65D 23/12* (2006.01)

(52) U.S. Cl. ..... 220/62.22; 220/694; 215/386

(58) Field of Classification Search ..... 215/381, 215/383, 379, 365, 386; 220/62.22, 62.12, 220/600, FOR. 165, FOR. 127, 592.27, 592.26, 220/592.24, 592.2, 694, 660; 200/694, 660; 40/310, 299.01; 156/DIG. 18, DIG. 9, DIG. 8; D9/516, 434, 537, 530, 549; 264/509; *B65D 90/02, 85/00*

See application file for complete search history.

(56) References Cited

U.S. PATENT DOCUMENTS

| | | | | | |
|---|---|---|---|---|---|
| 2,538,684 | A | * | 1/1951 | Gushard et al. | 215/382 |
| 3,733,002 | A | * | 5/1973 | Fujio | 215/12.2 |
| 4,138,026 | A | * | 2/1979 | Conklin | 215/12.2 |
| 4,976,798 | A | * | 12/1990 | Hoffman | 156/85 |
| 5,075,152 | A | * | 12/1991 | Tsukuda et al. | 428/204 |
| 5,178,289 | A | * | 1/1993 | Krishnakumar et al. | 215/382 |
| 5,227,233 | A | | 7/1993 | Itaba et al. | |
| 5,341,946 | A | * | 8/1994 | Vailliencourt et al. | 215/381 |
| 5,468,535 | A | | 11/1995 | Amano et al. | |
| 5,704,503 | A | * | 1/1998 | Krishnakumar et al. | 215/381 |
| 5,971,184 | A | * | 10/1999 | Krishnakumar et al. | 215/384 |
| 6,575,320 | B2 | * | 6/2003 | Ota et al. | 215/381 |
| 6,838,042 | B1 | * | 1/2005 | Wieners et al. | 264/509 |
| 2001/0006165 | A1 | * | 7/2001 | Rashid | 215/383 |
| 2001/0035392 | A1 | | 11/2001 | Ota et al. | |
| 2001/0038204 | A1 | * | 11/2001 | Nojima et al. | 283/81 |
| 2001/0054597 | A1 | | 12/2001 | Ozawa et al. | |
| 2002/0000421 | A1 | * | 1/2002 | Ota et al. | 215/381 |

(Continued)

FOREIGN PATENT DOCUMENTS

EP 0 560 211 A1 9/1993

(Continued)

*Primary Examiner* — Mickey Yu
*Assistant Examiner* — Robert J Hicks
(74) *Attorney, Agent, or Firm* — Oliff & Berridge, PLC

(57) ABSTRACT

A synthetic resin container having an improved strength without requiring use of increased resin amount has a container body with a plurality of sectioned recesses (3). In the disclosed invention, a label (4) is arranged on the container body (1) for improving the rigidity of the container by surrounding the container body.

11 Claims, 7 Drawing Sheets

U.S. PATENT DOCUMENTS

2003/0039775 A1 2/2003 Kong

FOREIGN PATENT DOCUMENTS

| | | |
|---|---|---|
| JP | U 064-49880 | 3/1989 |
| JP | U 03-87617 | 9/1991 |
| JP | A-06-127542 | 5/1994 |
| JP | A-08-113267 | 5/1996 |
| JP | A-10-139068 | 5/1998 |
| JP | A 2001-214139 | 8/2001 |
| JP | A-2001-240064 | 9/2001 |
| JP | A 2001-247107 | 11/2001 |
| JP | A-2002-120848 | 4/2002 |
| JP | A-2003-335343 | 11/2003 |
| WO | WO 03/029002 A1 | 4/2003 |

* cited by examiner

SYNTHETIC RESIN CONTAINER

TECHNICAL FIELD

The present invention relates to a container made of synthetic resin, such as polyethylene terephthalate (PET), polypropylene (PP), polyethylene (PE) or the like, and aims at further improvement of the strength (rigidity) of the container without increasing a use amount of the resin, while simplifying the classification works upon waste disposal.

BACKGROUND ART

Synthetic resin containers as represented by PET bottles are recently used widely, as container for beverages, seasonings, liquors, detergents, medicaments, or the like, since they are light in weight and easy to handle, they allow transparency to be preserved, they exhibit excellent appearance comparable to that of glass container, and they are less costly.

This type of containers encounters difficulty in reuse or disposal, and it would be desirable to reduce the amount of waste by decreasing, as far as possible, the amount of resin used to produce one bottle. On the other hand, however, if the amount of resin used for a container is simply reduced, the containers tend to be readily deformed due to the reduced rigidity of the container, per se, to thereby degrade the commercial value.

Thus, it has been a conventional practice to provide improved shape and appearance of the container and form the contained body with recesses of various configuration, to thereby preserve the rigidity of the container while reducing the use amount of resin (cf. JP 06-127542A).

Furthermore, in connection with disposal of used containers as waste, from the viewpoint of promoting recycling, there have been proposed containers wherein labels can be readily separated from the container body so as to allow a classified waste disposal, by the provision of separation assisting means, such as tabs, notches or perforations (cf. JP2002-120848A).

DISCLOSURE OF THE INVENTION

It is an object of the present invention to provide a novel synthetic resin container having improved strength and rigidity without requiring increase in the resin amount used, while allowing classification works for waste disposal to be eliminated.

To this end, according to the present invention, there is provided a synthetic resin container comprising a container body, said container body having a main body portion formed with a plurality of sectioned recesses, said container further comprising:

a label arranged at said main body portion of the container body and surrounding the main body portion, for providing an improved rigidity of the container.

It is preferred that the label is immovably arranged through an adhesive layer.

The label may be one of a heat-shrinkable label and a stretch label, which is tightly in close contact with the container body.

The label may comprise a tack label.

The label may comprise an essentially same type of material as the container, so as to eliminate burdensome classification works.

According to the present invention, since either the label itself, or the label in combination with the adhesive layer, functions as reinforcement for the container, the strength of the contained can be further improved without increasing the amount of resin. Thus, the arrangement according to the present invention is particularly useful for resource savings.

Generally, in a contents filling line, the container after having been filled with the contents is subjected to a shower treatment process for the purpose of cooling or sterilization by heating. Therefore, it is preferred from sanitary viewpoint to apply the label to the container before the shower treatment process, in order to prevent entry of water into the recesses and thereby avoid formation of wrinkles.

Furthermore, according to the present invention, when a heat shrinkable label is used, the expansion force of the container occurring during the hot filling or heat sterilization is resisted by the shrinking force of the label to suppress deformation of the container. Besides, the closed spaces between the label and the recesses function as heat insulating layers so that the container can be readily grasped even when the contents are maintained at high temperature.

Moreover, according to the present invention, when the label is comprised of an essentially same type of material as the container, it is possible to eliminate burdensome classification works upon waste disposal.

BEST MODE FOR CARRYING OUT THE INVENTION

Figure 1:
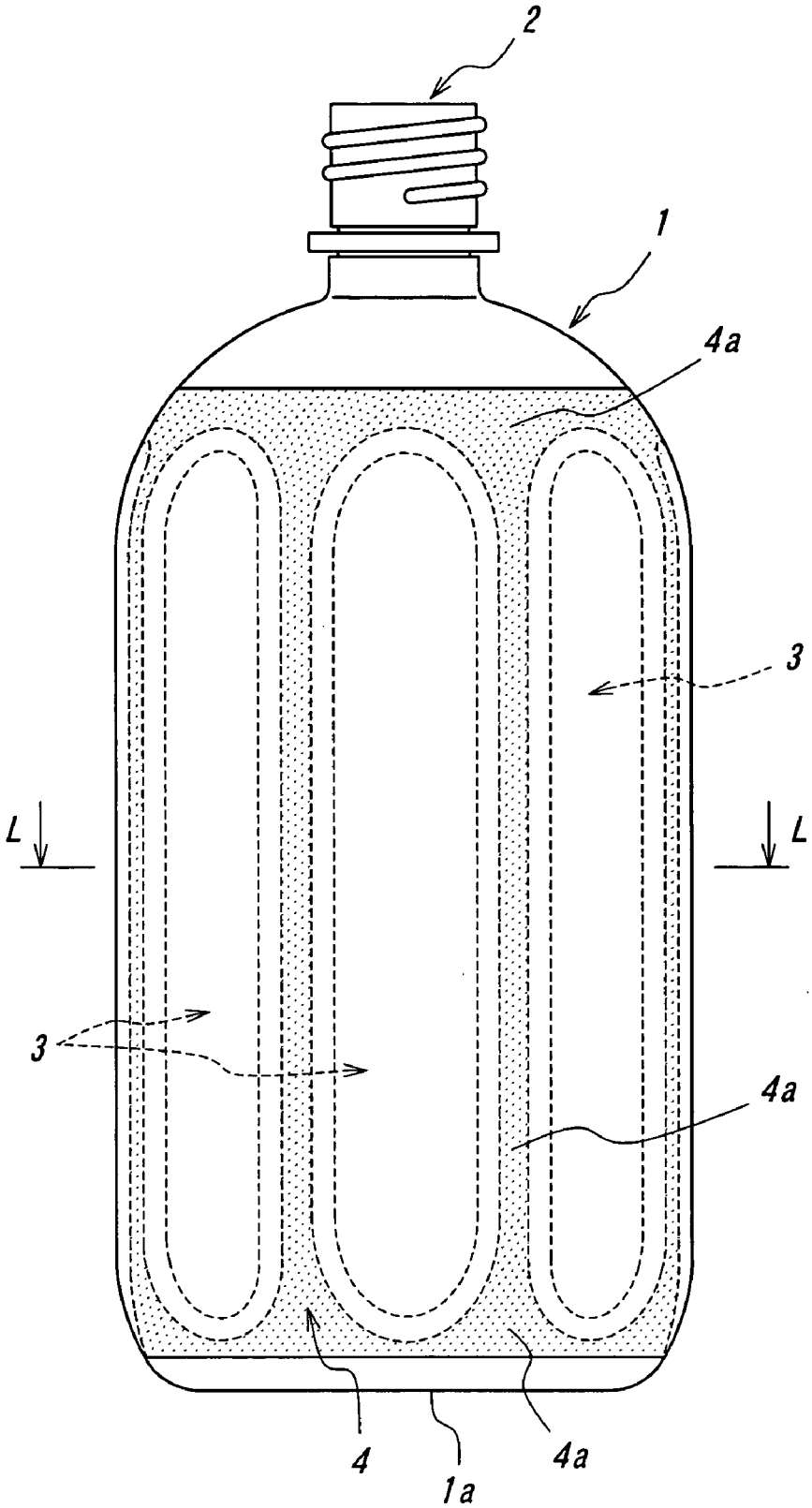
FIG. 1 is a front view of a container according to one embodiment of the present invention.
Figure 2:
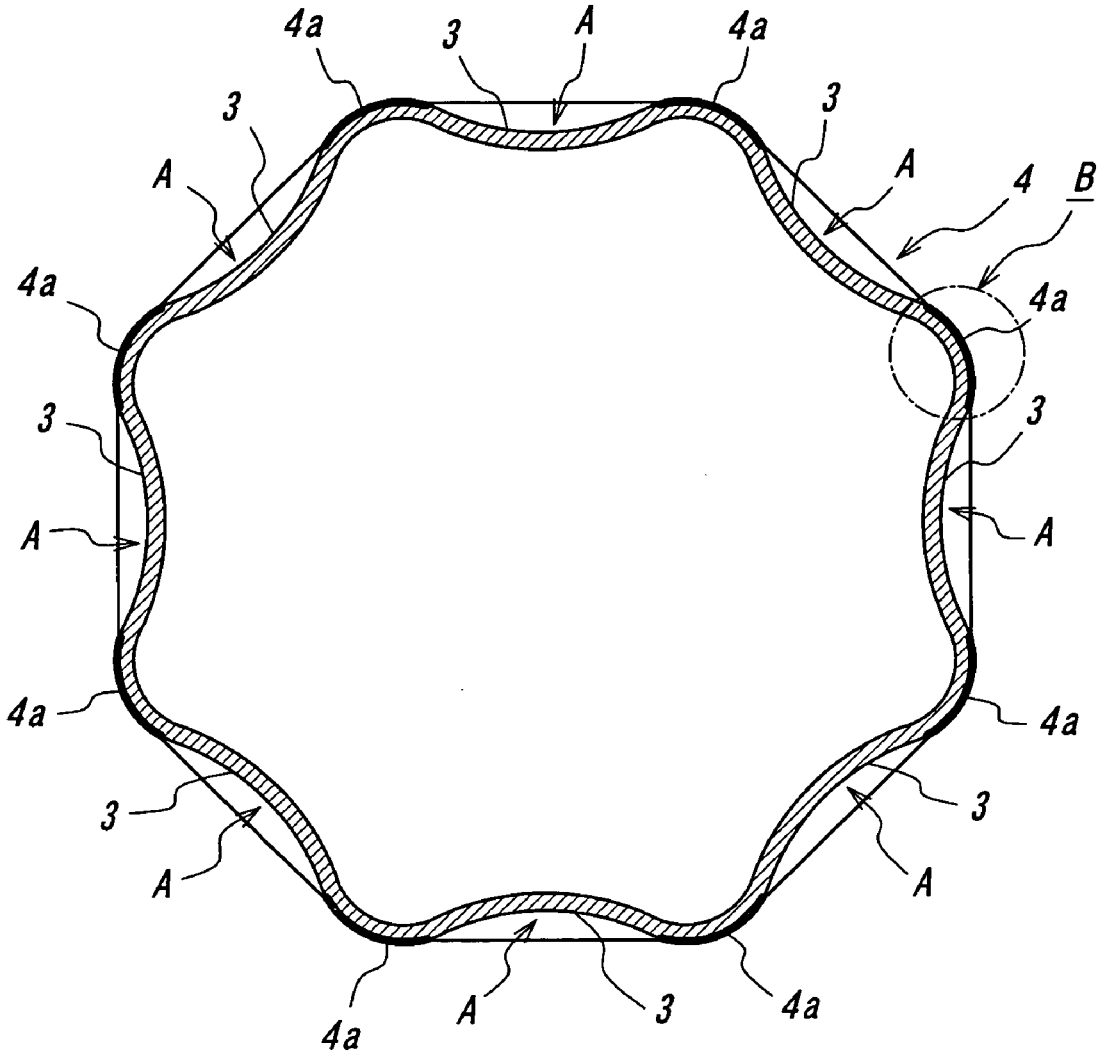
FIG. 2 is a sectional view taken along the line L-L in FIG. 1.

The present invention will be described below with reference to the drawings. FIGS. 1 and 2 illustrate the synthetic resin container according to the present invention, which is in the form of a bottle-type container, by way of example, wherein FIG. 1 is the front view and FIG. 2 is a sectional view along line L-L in FIG. 1.

Reference numeral 1 in FIG. 1 denotes a container body having an inner space to be filled with contents, 2a mouth portion connected integrally to the container body 1, and 3 a plurality of sectioned recesses provided for the main body portion of the container body 1. These sectioned recesses 3 serve as pressure reduction absorption walls for preventing deformation due to a pressure drop within the container, which arises, for example, upon cooling of the contents filled under hot temperature. Here, the term "main body portion" refers to an entire peripheral wall of the container body 1, excluding the mouth portion 2 and the bottom portion 1*a* of the container body 1.

Reference numeral 4 denotes a label, which covers the sectioned recesses 3 and defines closed spaces (air layers) A together with the main body portion of the container body 1. The label 4 is made of an essentially same type of material as the container, and is adhered to the main body portion of the container body 1 through an adhesive layer 4*a*. The label made of essentially the same type of material as the container, as used herein, means that the material forming at least the base material layer is essentially of the same type as the major material of the container.

When the label 4 is adhered to the main body portion of the container body 1 through the adhesive layer 4*a*, air layers isolated from ambient air are formed in the sectioned recesses 3, which serve as reinforcements for the container for providing a higher rigidity, and also as cushion materials for absorbing impacts from outside.

Figure 3:
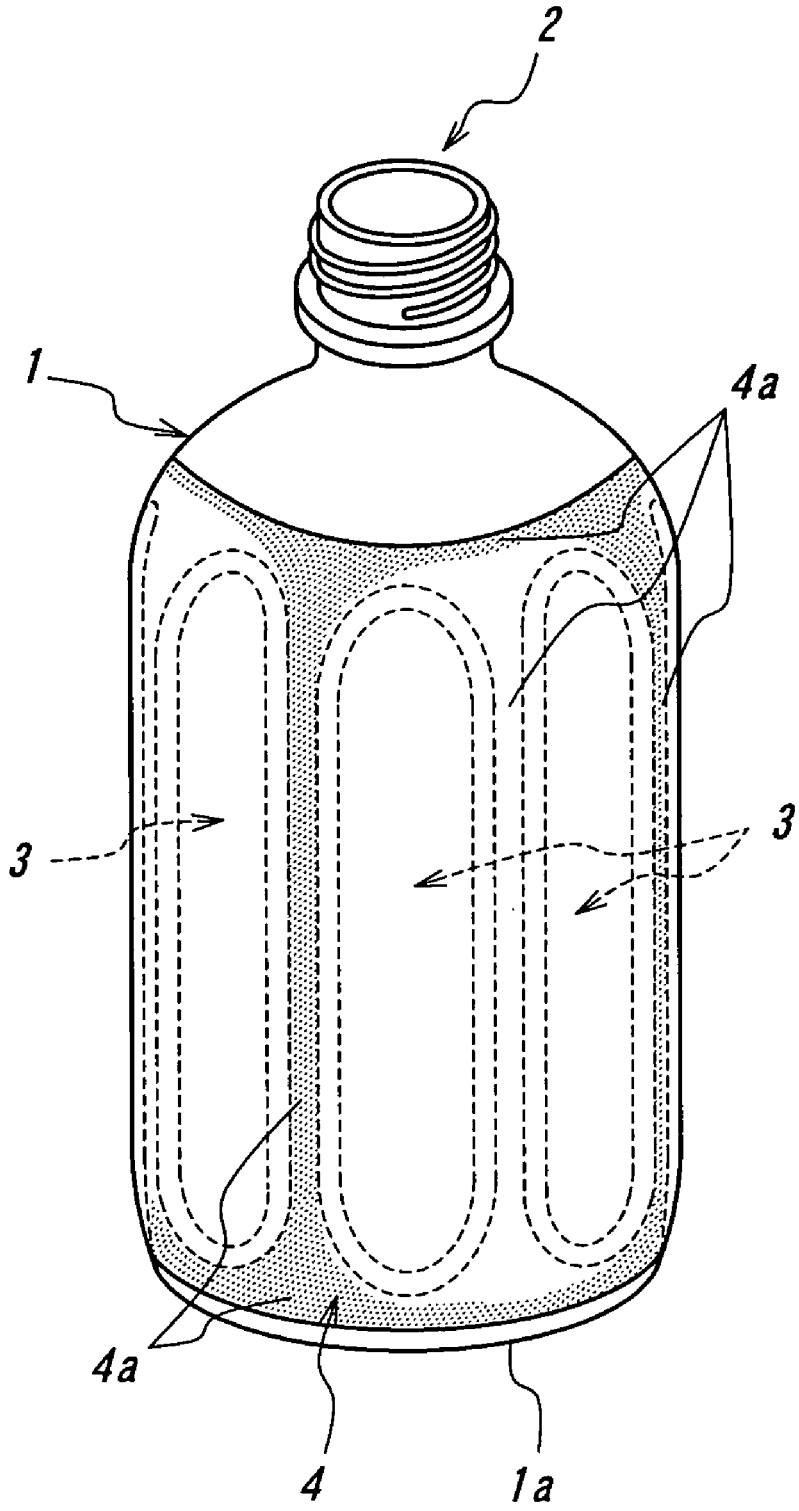
FIG. 3 is a perspective view of a container according to another embodiment of the present invention.

With reference to FIGS. 1 and 2, the label 4 has been described as being adhered to the main body portion of the container body 1 except the sectioned recesses 3. However, according to the present invention, the label 4 may be adhered to the main body portion along the entire periphery at the upper end region or the lower end region of the label 4. Alternatively, or additionally, the label may be adhered to the main body portion of the container body 1 along several regions extending in the longitudinal direction of the container body. These measures also provide improved rigidity of the container. The arrangement for the adhesive layer 4*a* of the label 4 is not particularly limited; hence, the adhesive layer 4*a* may be provided on the entire back surface of the label 4, or only at the required regions thereof. FIG. 3 shows another embodiment of the present invention in which the label is adhered to the main body portion of the container body 1 at its upper and lower end regions, and also along several longitudinal regions of the main body portion of the container body 1.

Figure 4:
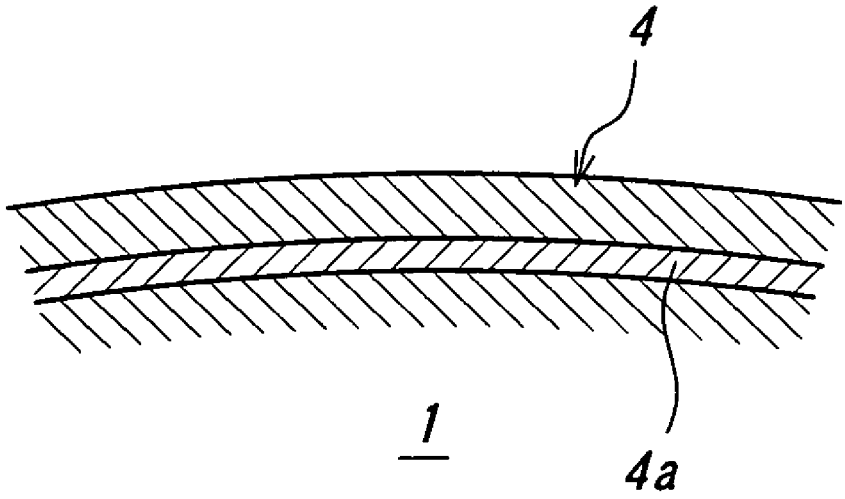
FIG. 4 is a sectional view showing one example of a region B in FIG. 2.
Figure 5:
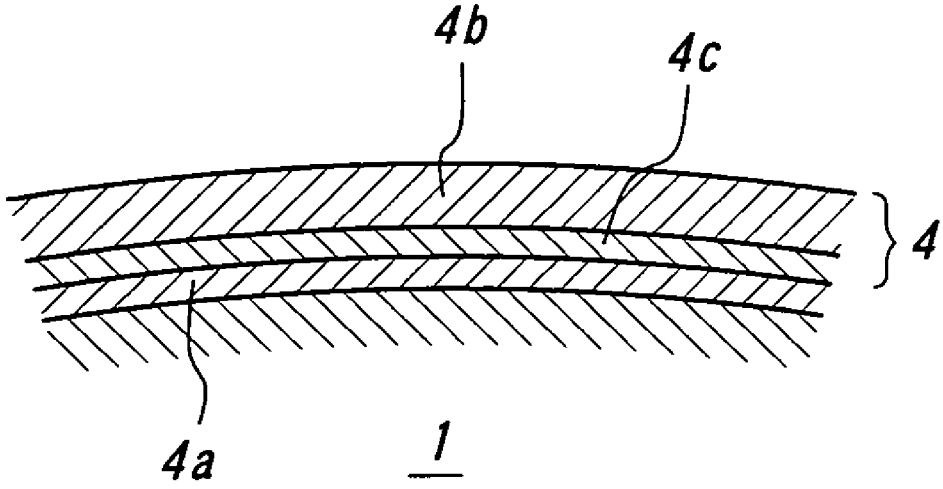
FIG. 5 is a sectional view showing another example of the region B in FIG. 2.

Region B in FIG. 2 is shown in an enlarged scale in FIG. 4. It can be seen that the label 4 is adhered to the container body 1 through the adhesive layer 4*a* (heat-sensitive adhesive agent, etc.), and has a two-layered basic structure. However, as shown in FIG. 5, the label 4 may be of a laminated structure comprising a base layer 4*b*, which consists of essentially the same type of material as the container body 1, and a barrier layer 4*c* that is laminated on the base layer 4*b*. Although not shown in the drawings, the label 4 may further comprise a printed layer between the base layer 4*b* and the barrier layer 4*c*.

Figure 6:
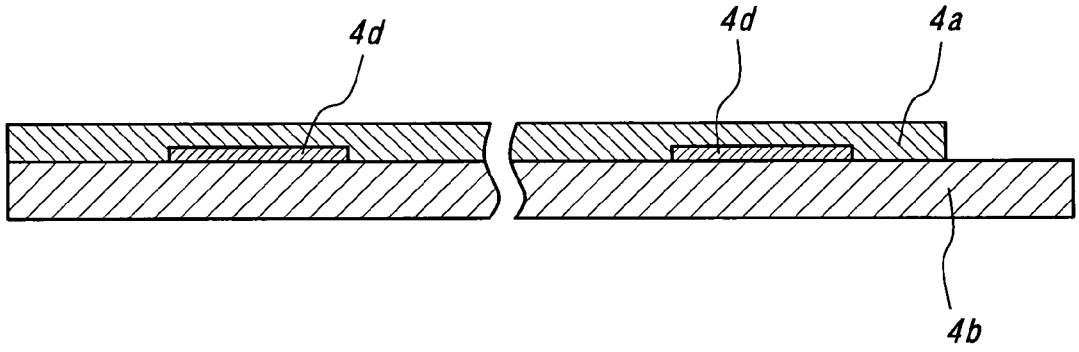
FIG. 6 is an enlarged sectional view of the label.
Figure 7:
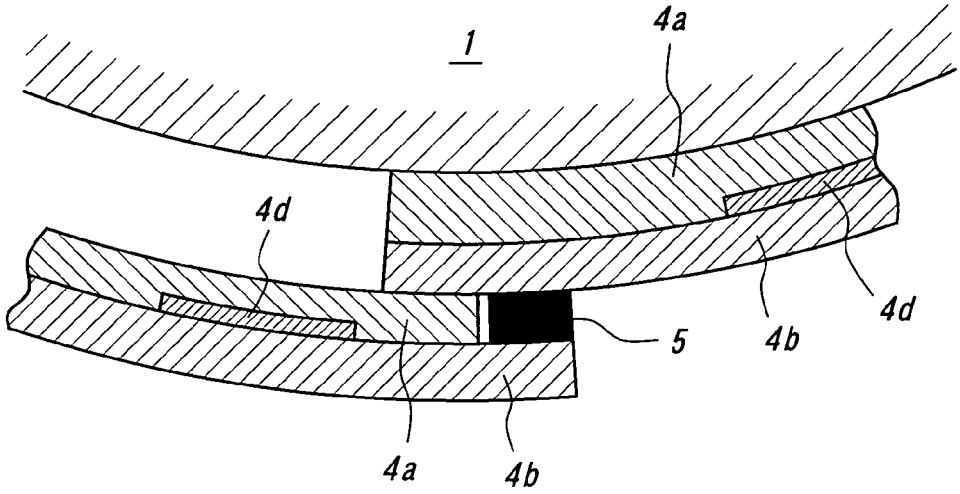
FIG. 7 is a view showing the label that has been deformed into a cylindrical shape.

FIG. 6 is an enlarged view showing the label (heat-shrinkable label) which can be suitably applied to the container according to the present invention, wherein the label is shown as being in the form of a sheet. Here, a sheet-like film forming the base layer 4*b* has a surface which is applied with a heat-sensitive adhesive agent except along its one edge, so as to form the adhesive layer 4*a*. A cylindrical label 4 is formed by rolling up the sheet-like film and joining the leading and trailing ends with each other by the adhesive agent 5, and has a laminated structure comprised, as seen from the inner side, of the adhesive layer 4*a* (heat-sensitive adhesive agent), the base layer 4*b*, the adhesive layer 4*a* (heat-sensitive adhesive agent)/adhesive agent 5, and the base layer 4*b*, so as to positively prevent gas transmission through the joined portion, and also to provide an improved strength.

Other than a heat-shrinkable label, the label 4 may comprise a stretch label wherein a stretch film is formed into a cylindrical shape. As for the heat-shrinkable label, in particular, it is preferred to use a resin that is essentially of the same type as the container body, since troublesome separation of the label from the container body is not required upon disposal of the used container, and the same type of resin exhibits the same tendency in deformation characteristic which is thus easy to control.

Figure 8A:
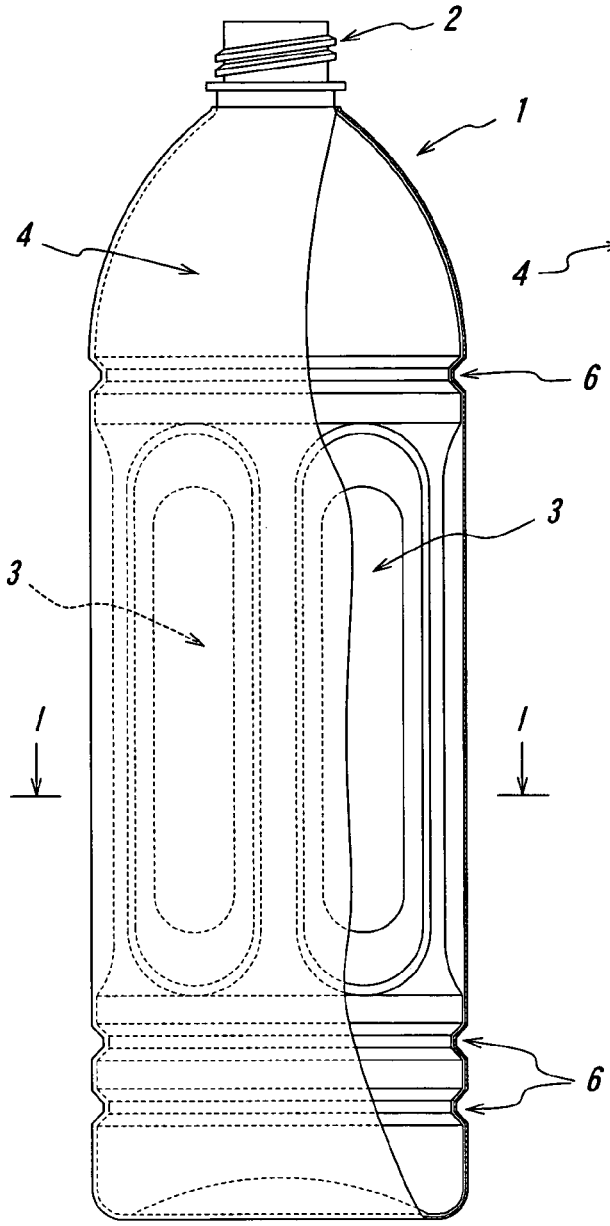
FIG. 8*a* is a side view of a container suitable for applying a non-adhesive type label.
Figure 8B:
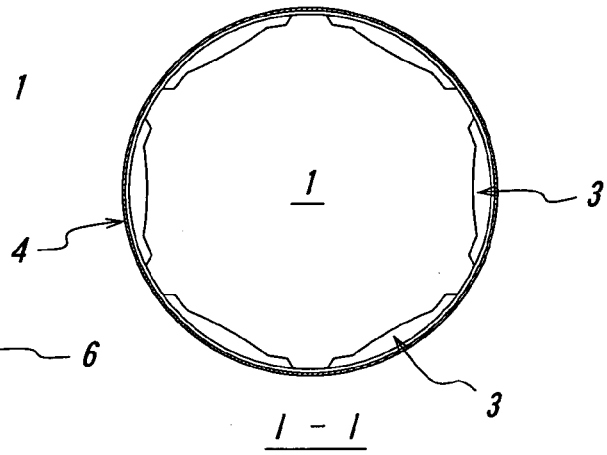
FIG. 8*b* is a sectional view taken along the line I-I in FIG. 8*a*.

When the label 4 is comprised of a non-adhesive label (i.e., a label without the adhesive layer), which is brought into tight contact with the main body portion of the container body 1, as shown in FIGS. 8*a* and 8*b*, it is preferred that at least one annular groove portion 6 is provided on each side, i.e., the upper side and the lower side, of the sectioned recesses 3, since the provision of such annular groove portions serves to improve the tightness of the contact.

The container according to the present invention can be produced by a conventional process, such as blow molding or injection molding, by using such resin as PET, PP, PE or the like. However, the present invention is not limited to these resins, and the shape of the container may be suitably selected as bottle-shape, cup shape or any other shape.

Embodiment 1

In order to demonstrate functional advantages of the present invention, there have been produced samples of container of substantially circular cross-section, exhibiting an appearance substantially as shown in FIG. 1. Each sample container has a capacity of 500 milliliters, and is formed with sectioned recesses in the main body portion. These sample containers were produced by biaxial stretch blow molding process using 21 grams of PET resin. Then, the sample container was applied with a label of essentially the same kind of resin as the container (i.e., a heat-shrinkable label applied with a heat-sensitive glue or adhesive agent for the inventive example 1, and a non-adhesive type heat-shrinkable label for the inventive example 2, both having a base layer comprising PET and a thickness of 40 μm). After the label has been applied to the container, the label has been subjected to shrinkage by steam. For there sample containers, the buckling strength, the rigidity of the main body portion and the columnar rigidity have been investigated. The data obtained by such investigations are shown in Table 1 below, together with the data for a reference container (control example) which is not provided with the label.

In Table 1, the term "empty" refers to an empty container not filled with contents, while the term "full" refers to a container filled with hot water at 85° C., then maintained for 45 seconds in an overturned state and for another 5 minutes 15 seconds in an upright state before it has been subjected to cooling.

Figure 9:
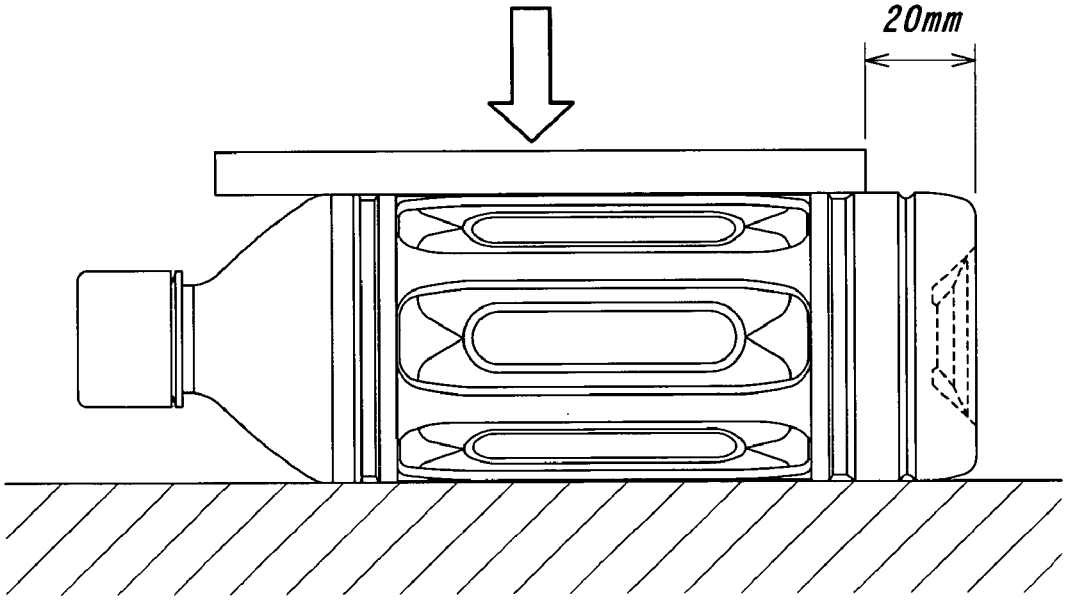
FIG. 9 is a view showing the method for testing the rigidity of the container body.

Furthermore, the term "buckling strength (N)" refers to the load upon occurrence of buckling of the container when the container in upright state is compressed from its upper side (mouth portion side) toward the bottom side by using a disc of 100 mm in diameter, which is moved at a speed of 50 mm/min, with an air vent placed between the disc and the mouth portion in the case of the empty bottle. The term "body portion rigidity (mm)" refers to the displacement of the bottle when the contained maintained at 5° C. for 24 hours was placed in an overturned state with one of its columnar portions (projections between the sectioned recesses) oriented upwards as the upper surface, and a square rod of a width 10 mm×10 mm and a length of 150 mm was arranged in parallel with an axis that connects the mouth portion side and the bottom portion side (with one end of the rod spaced from the bottom of the container by 20 mm, as shown in FIG. 9), before a vertical load of 58.8 N (6 kgf) was applied through the rod to the container from the upper surface side toward the lower surface side. Furthermore, the term "columnar rigidity (N)" refers to the load upon occurrence of buckling of the container when the container was placed in an overturned state with one of its columnar portions oriented upwards as the upper surface, and a cylindrical rod of a diameter 20 mm and a length of 100 mm was arranged at right angles to the axis that connects the mouth portion side and the bottom portion side so as to vertically compress the center region of the columnar portion. The data obtained are shown in Table 1 as indices with reference to the data of the control example indicated as 100.

TABLE 1

| Measurements | | Examples | | |
|---|---|---|---|---|
| | | Inventive Example 1 | Inventive Example 2 | Control Example |
| Buckling strength | Empty | 130 | 112 | 100 |
| | Full | 117 | 109 | 100 |
| Body portion rigidity | Empty | 124 | 108 | 100 |
| | Full | 120 | 107 | 100 |
| Columnar rigidity | Empty | 137 | 111 | 100 |
| | Full | 132 | 113 | 100 |

It can be understood from Table 1 that the inventive example 2 in which the main body portion of the container body is applied with a non-adhesive type label provided improved buckling strength, body portion rigidity and columnar rigidity, as compared to the control example. Moreover, the inventive example 1 in which a heat shrinkable label is applied by adhesion provides further improved buckling strength, body portion rigidity and columnar rigidity, even when compared to the inventive example 1.

Incidentally, the data obtained for the inventive examples 1 and 2 are with respect to the so-called pre-label type bottles in which an empty bottle is applied with a label before the filling of the contents. However, it has been confirmed that similar results are obtained with respect to the so-called after-label type bottles in which a label is applied to the container after the filling of the contents.

INDUSTRIAL APPLICABILITY

It will be appreciated from the foregoing description that the present invention provides a contained made an amount of resin, which has been reduced as far as possible, yet preserving a required rigidity.

The invention claimed is:

1. A synthetic resin container comprising a container body of a first material, said container body having a main body portion formed with a plurality of sectioned recesses, said container further comprising:

a label of a same material as the container body for purposes of waste disposal classification, arranged at said main body portion of the container body and surrounding the main body portion, that provides an improved rigidity of the container; and an annular groove portion located above the plurality of sectioned recesses, wherein:

the label extends above the annular groove portion;

the label is immovably arranged on the main body portion; and closed air layers are provided between the plurality of sectioned recesses and the label.

2. The container according to claim 1, wherein said label is one of a heat-shrinkable label and a stretch label, which is tightly in close contact with the container body.

3. The container according to claim 1, wherein said label is a tack label.

4. The container according to claim 1, wherein the closed air layers form a cushion structure that absorbs impacts from outside for the container.

5. The container according to claim 1, wherein the container has a longitudinal axis and the label is adhered at upper and lower end regions of the label along the longitudinal axis.

6. The container according to claim 1, wherein the container has a longitudinal axis, and further comprises annular groove portions extending about the longitudinal axis on opposite sides of the plurality of sectioned recesses, the annular groove portions being covered by the label.

7. The container according to claim 6 wherein the label is a heat-shrinkable label with a heat-sensitive adhesive agent.

8. The container according to claim 1, wherein the first material is polyethylene terephthalate (PET).

9. The container according to claim 1, wherein the label is immovably arranged on the main body portion through an adhesive layer.

10. The container according to claim 1, wherein the label is a non-adhesive label.

11. The container according to claim 1, wherein the plurality of sectioned recesses do not include a protrusion within the plurality of sectioned recesses that contacts the label.

* * * * *